United States Patent [19]

Cotignoli

[11] Patent Number: 4,660,534

[45] Date of Patent: Apr. 28, 1987

[54] ELECTRONIC IGNITION SYSTEM WITH STATIC DISTRIBUTION FOR A CARBURETTOR ENGINE

[75] Inventor: Giuseppe Cotignoli, Collegno, Italy

[73] Assignee: Marelli Autronica S.p.A., Pavia, Italy

[21] Appl. No.: 749,891

[22] Filed: Jun. 28, 1985

[30] Foreign Application Priority Data

Jun. 29, 1984 [IT] Italy ..... 67668 A/84

[51] Int. Cl.[4] ..... F02P 3/04; F02P 7/00

[52] U.S. Cl. ..... 123/643; 123/644; 123/651

[58] Field of Search ..... 123/609, 643, 644, 651

[56] References Cited

U.S. PATENT DOCUMENTS

| | | | |
|---|---|---|---|
| 4,112,895 | 9/1978 | Habert | 123/643 X |
| 4,207,846 | 6/1980 | Borst et al. | 123/643 X |
| 4,216,755 | 8/1980 | Ordines | 123/643 |
| 4,248,200 | 2/1981 | Sugiura et al. | 123/644 |
| 4,262,647 | 4/1981 | Torii et al. | 123/651 |
| 4,378,004 | 3/1983 | Petrie | 123/643 |
| 4,483,293 | 11/1984 | Akasu | 123/643 X |

*Primary Examiner*—Willis R. Wolfe, Jr.

*Attorney, Agent, or Firm*—Sughrue, Mion, Zinn, Macpeak and Seas

[57] ABSTRACT

An electronic ignition system, for a four-stroke, four-cylinder engine, having:

sensors that provide signals indicative of the running conditions of the engine, two ignition transformers, each having their respective output windings connected to the spark plugs of a respective pair of cylinders of the engine, means for monitoring the current flow in the respective input windings of the two transformers, switching means for selectively and alternately connecting output of a single integrated circuit to the input windings of the two transformers, and a microprocessor unit. The switching means has two electronically controlled switch devices, respectively in series with the input winding of the first and of the second ignition transformer, connected together in a current path in parallel. A third switch device, controlled by the microprocessor unit, selectively connects the output of the single integrated circuit controlling the angle of "dwell" to either the first or the second controlled switch device, in dependence on the signals provided by the microprocessor unit.

5 Claims, 2 Drawing Figures

ELECTRONIC IGNITION SYSTEM WITH STATIC DISTRIBUTION FOR A CARBURETTOR ENGINE

The present invention relates to an electronic ignition system with static distribution for a carburetor. engine.

In particular, the invention concerns an electronic ignition system for a four-stroke, four-cylinder engine, the ignition system includes:

- sensor means which provide signals indicative of the running conditions of the engine,
- a first and a second ignition transformer having their respective output windings connected to the spark plugs of a respective pair of engine cylinders,
- means for monitoring the current flow in the input windings of the transformers,
- switching circuit means for selectively and alternately energizing the input windings of the transformers,
- a micro-processor unit predisposed to provide, in dependence on the data furnished thereto by the sensor means, command signals directed to
- integrated circuit means for controlling the angle of "dwell" for controlling the switching means at each ignition in dependence on the signals emitted by the microprocessor unit and on the signals provided by the monitoring means at the preceding ignition.

An electronic ignition system with static distribution of the known type described above is schematically illustrated in FIG. 1 of the appended drawings. In this drawing, there is shown a phonic wheel-type sensor 1 comprising a rotatable member 2 equipped with at least one detectable reference 3 and with two fixed pick-up elements 4*a* and 4*b* arranged at 180° to each other. The output of each pick-up element is connected to the input of a micro-processor unit 5 (μp) by means of a pulse-shaping and -forming circuit 6 (P.S.F.) (for example, a "trigger" circuit). The micro-processor unit 5 also has inputs connected to further sensors, for example, an engine temperature sensor 7 (E.T.S.) and a sensor 8 (V.S.) responsive to the degree of vacuum in the induction manifold of the engine.

The electronic microprocessor unit 5 is predisposed by means of conventional programming techniques, to carry out electronic monitoring of the ignition advance, and to control the ignition in the cylinders of the engine by means of two identical control circuit modules 9 and 10, which will be described hereinafter. These circuit modules are respectively connected to a first and to a second controlled switch device 11, 12 (F.C.S. and S.C.S.) (for example, 'Darlington' transistors) which in turn are connected to the input or primary windings 14*a*, 15*a* of two ignition transformers or 'coils' 14 and 15. The transformer 14 has its output or secondary winding 14*b* connected to the spark plugs C1 and C4 of a pair of cylinders of the engine, whilst the output or secondary winding 15*b* of the transformer 15 is connected to the spark plugs C2 and C3 of the other two cylinders.

Two feedback circuits 16 and 18 (FB.C.) are respectively connected between the controlled switch devices 11 and 12 and the respective control circuit modules 9 and 10. The latter, each of which may, for example, comprise a dedicated integrated circuit L 482, manufactured and marketed by the Company SGS-ATES, each comprise a circuit 20 (C.F.C.) for controlling current flow in the associated primary winding of the transformer 14 or 15. This control circuit is of a conventional type, and is also known as a circuit for controlling the angle of "dwell".

Each control circuit 20 is followed by a power stage 21 (D.S.) or "driver" stage, for example, with transistors.

The known type of ignition system illustrated in FIG. 1 operates in the following manner. In dependence on the signals provided by the sensors 1, 7, 8 . . . the microprocessor unit 5 through the circuit modules 9 and 10 determines the alternate switching of the switch devices 11 and 12, thus alternately energizing the primary windings 14*a* and 15*a* of the ignition transformers 14 and 15. As a result, ignition is effected alternately, through the secondary windings 14*b* and 15*b* in the two pairs of cylinders of the engine, in dependence particularly on the signal provided by the sensor 1. At each ignition in the pair of cylinders associated therewith each feedback circuit 16 or 18 furnishes to the respective circuit module 9 or 10 a signal indicative of the magnitude of the current flow in the primary winding 14*a* or 15*a*. On the basis of information thus obtained, and of the signals provided by the microprocessor unit 5, each circuit module 9 or 10 determines, according to pre-established methods, the magnitude and the duration of the current flow in the primary winding of the related ignition transformer at the subsequent ignition.

The known type of circuit described above has the disadvantage of requiring two circuit modules for controlling the angle of "dwell", which proves to be somewhat costly, and two feedback circuits for monitoring the magnitude of the current flowing in the ignition transformers.

SUMMARY OF THE INVENTION

The object of the present invention is to provide an ignition system of the type previously defined, which has a drastically simplified circuit structure compared with the known type of circuit previously described and which is thus capable of being produced more economically whilst, at the same time, ensuring a performance comparable with that of the previous system.

This object is achieved according to the invention by means of an electronic ignition system with static distribution of the type previously defined, the main characteristic of which resides in the fact

- that the integrated circuit means for controlling the angle of dwell includes a single integrated circuit for controlling the angle of dwell, of the type capable of controlling the ignition transformer of a pair of cylinders;
- that the switching circuit means includes a first and a second electronically controlled switch device, respectively in series with the input winding of the first and of the second transformer and connected together in a current path in parallel; and a third electronically controlled switch device connected to the microprocessor unit and capable of connecting selectively the control output of said integrated circuit for controlling the angle of "dwell" to the first or second controlled switch device in dependence on the signals emitted by the microprocessor unit;
- the monitoring means includes a single feedback circuit, connected to the current path and to the integrated circuit for controlling the angle of "dwell".

BRIEF DESCRIPTION OF THE DRAWINGS

Further characteristics and advantages of the electronic ignition system according to the invention will appear from the detailed description that follows, given with reference to the appended drawings, in which.

DETAILED DESCRIPTION OF THE PREFERRED EMBODIMENT

Figure 2:
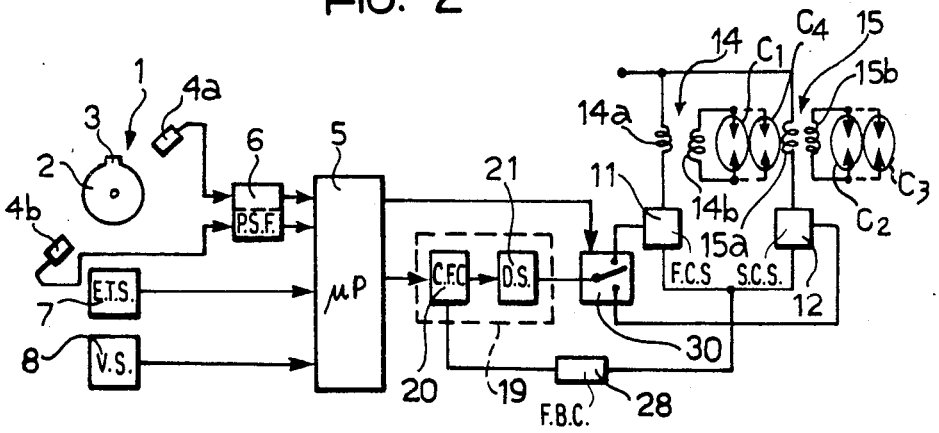
FIG. 2 is a block-schematic diagram of embodiment of an ignition system according to the invention.

FIG. 2, furnished purely as a non-limiting example, illustrates an embodiment of an ignition system according to the invention.

In FIG. 2, the same reference numerals are used to designate elements and components already described with reference to FIG. 1.

The ignition system shown in FIG. 2 includes a single integrated circuit 19 for controlling the angle of "dwell" and of ignition, this also consisting, for example, of an integrated circuit L482 of the SGS-ATES Company. The output of the integrated circuit 19 is connected to a switching device 30 controlled by the microprocessor unit 5. The switching circuit 30, which may be made up of transistors, has two outputs connected to the control inputs of the controlled switching devices 11 and 12. The latter are connected together (in the case of 'Darlington' transistors, these have their emitters connected together) and their common terminal is connected to the integrated circuit 19 by means of a single feedback circuit 28 (FB.C.), for example, a current divider, structurally identical to the feedback circuits 16 and 18 of FIG. 1.

During operation, the microprocessor unit 5, through the switching circuit 30 and the integrated circuit 19, connects in the circuit the primary windings 14*a* and 15*a* of the two ignition transformers selectively and alternately. Since, when one of these windings conducts the other carries no current, and vice versa, a single feedback circuit is sufficient to "inform" the integrated circuit 19 of the magnitude of the current in these windings. At each ignition in a pair of cylinders, the current circulating in the primary winding of the corresponding transformer is controlled by the integrated circuit 19 in dependence on the magnitude of the current measured, during the course of the immediately preceding-ignition, by means of the feedback circuit 28.

Thus the current made to flow in the primary winding 14*a* to effect ignition is regulated in dependence on the current that flowed in the winding 15*a* during the immediately preceding ignitiion, and so on. It is therefore evident that, in order to obtain correct operation of the ignition system according to the invention, the windings 14*a* and 15*a* should as far as possible be identical. Such a condition can, however, be easily fulfilled.

Figure 1:
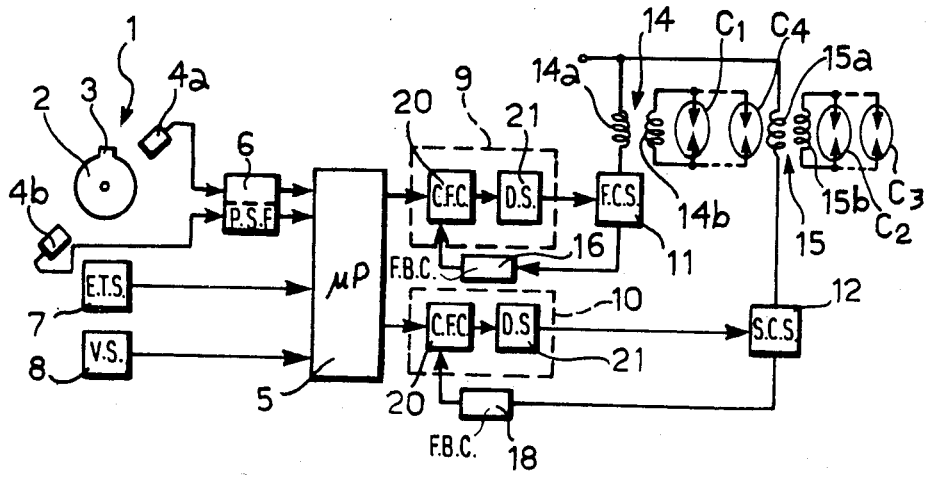
FIG. 1 is a block-schematic diagram of a known ignition system.

The microprocessor unit 5 of the system illustrated in FIG. 2 is, in terms of its circuit, identical to that of the system shown in FIG. 1. While there may be some minor differences in the operating program of this unit, such differences would be fairly insignificant and would be instantly recognized by someone skilled in the art.

As may be observed upon comparison of FIGS. 1 and 2, the electronic ignition system as shown in FIG. 2 has a decidedly simplified structure and thus is more economical.

Naturally, while the principle of the invention remains the same, embodiments and details of production may be varied widely in relation to what has been described and illustrated herein purely by way of a non-limiting example, without thereby departing from the scope of the present invention.

I claim:

1. An electronic ignition system with static distribution for a carburetor engine, in particular for a four-stroke, four-cylinder engine, said electronic ignition system comprising:

(a) sensor means (1,7,8) for providing data signals indicative of the running conditions of the engine, (b) a first ignition transformer (14), said first transformer having an input winding (14*a*) and an output winding (14*b*), said output winding being connected to a first pair of spark plugs ($C_1$,$C_4$) of a first pair of engine cylinders, respectively, (c) a second ignition transformer (15), said second transformer having an input winding (15*a*) and an output winding (15*b*), said output winding being connected to a second pair of spark plugs ($C_2$,$C_3$) of a second pair of engine cylinders, respectively.

(d) a micro-processor unit (5) for providing command signals in response to said data signals from said sensor means, (e) first and second electronically controlled switch devices (11,12), said first and second switch devices being respectively connected in series with the input winding of said first and second transformers, and said first and second switch devices being connected together in a current path in parallel, (f) monitoring means, having a single feedback circuit (28) connected to said current path, for providing an output indicative of current flow in the input windings of said first and second transformers, respectively, (g) integrated circuit means for controlling the angle of "dwell" at each ignition in response to said command signals provided by said microprocessor unit and said output at the preceding ignition provided by said monitoring means, wherein said integrated circuit control means includes an integrated circuit (19) for providing a control signal for controlling the angle of "dwell", said control signal being of a type capable of controlling the ignition transformer of a pair of cylinders, and (h) a third electronically controlled switch device (3) for selectively and alternately connecting said control signal of said single integrated circuit to said first and second controlled switch devices in response to said command signals provided by said microprocessor unit.

2. An electronic ignition system with static distribution according to claim 1, wherein said third electronically controlled switch device comprises transistors.

3. An electronic ignition system with static distribution according to claim 2, wherein each of said first and second electronically controlled switch devices incorporates one of a 'Darlington' transistor and a 'MOSFET'-type transistor.

4. An electronic ignition system with static distribution according to claim 3, wherein said third electronically controlled switch device comprises transistors.

5. An electronic ignition system with static distribution according to any one of claims 3, 4, 1 or 2, wherein said feedback circuit comprises a voltage divider.

* * * * *